US007271530B2

(12) United States Patent
Kuribayashi et al.

(10) Patent No.: US 7,271,530 B2
(45) Date of Patent: Sep. 18, 2007

(54) FILAMENT FOR X-RAY TUBE AND X-RAY TUBE HAVING THE SAME

(75) Inventors: Masaru Kuribayashi, Akishima (JP); Masahiro Nonoguchi, Tachikawa (JP); Naohisa Osaka, Ome (JP); Yoji Kobayashi, Akiruno (JP)

(73) Assignee: Rigaku Corporation, Akishima-shi (JP)

( * ) Notice: Subject to any disclaimer, the term of this patent is extended or adjusted under 35 U.S.C. 154(b) by 0 days.

(21) Appl. No.: 11/583,747

(22) Filed: Oct. 19, 2006

(65) Prior Publication Data

US 2007/0090744 A1 Apr. 26, 2007

(30) Foreign Application Priority Data

Oct. 21, 2005 (JP) ..... 2005-306547

(51) Int. Cl.
*H01J 1/15* (2006.01)

(52) U.S. Cl. ..... 313/341; 313/271

(58) Field of Classification Search ..... 313/341
See application file for complete search history.

(56) References Cited

U.S. PATENT DOCUMENTS

| | | | |
|---|---|---|---|
| 3,631,289 | A | 12/1971 | Picker et al. |
| 6,356,619 | B1 | 3/2002 | Nagy et al. |
| 2005/0232396 | A1 | 10/2005 | Chidester |
| 2007/0092064 | A1 | 4/2007 | Kuribayashi |

FOREIGN PATENT DOCUMENTS

| | | | |
|---|---|---|---|
| JP | 58-026144 B * | 6/1983 | |
| JP | 58-026144 B2 | 6/1983 | |
| JP | 63-232264 A | 9/1988 | |
| JP | 01-161547 U | 11/1989 | |
| JP | 05-242842 A | 9/1993 | |
| JP | 06-009047 U | 2/1994 | |
| JP | 10-334839 A | 12/1998 | |
| JP | 2001-297725 A | 10/2001 | |

OTHER PUBLICATIONS

Related U.S. Appl. No. 11/583,448, filed Oct. 19, 2006, Title: "Filament for X-Ray Tube and X-Ray Tube Having the Same", Inventors: Masaru Kuribayashi et al; Allowed on Feb. 22, 2007.

* cited by examiner

*Primary Examiner*—David Bruce
*Assistant Examiner*—Conrad R Blease
(74) *Attorney, Agent, or Firm*—Frishauf, Holtz, Goodman & Chick, P.C.

(57) ABSTRACT

A filament for an X-ray tube has a varied wire diameter but has a constant coil outside diameter to obtain a good uniformity of the longitudinal temperature distribution of the filament. The filament has a wire diameter d which is gradually reduced from the longitudinal central region to the longitudinal ends while the coil outside diameter D is fixed along the longitudinal direction. The wire is polished at only the inside of the coil to reduce the wire diameter. In order to make the longitudinal temperature distribution uniform as far as possible, the difference Δd between the wire diameter $d_{max}$ at the longitudinal central region and the wire diameter $d_{min}$ at the longitudinal ends should satisfy the following limitation:

$$\Delta d/d_{max}=0.041 \text{ to } 0.145.$$

8 Claims, 10 Drawing Sheets

FIG. 5

| | Wire diameter difference Δd (mm) | Temperature difference ΔT (℃) | $\Delta d/d_{max}$ |
|---|---|---|---|
| Observed value | 0 | −109 | 0 |
| | 0. 04 | 42 | 0. 133 |
| | 0. 085 | 115 | 0. 283 |
| | 0. 123 | 160 | 0. 410 |
| Recommended value | 0. 0122 | −50 | 0. 041 |
| | 0. 0250 | 0 | 0. 083 |
| | 0. 0436 | 50 | 0. 145 |

FILAMENT FOR X-RAY TUBE AND X-RAY TUBE HAVING THE SAME

BACKGROUND OF THE INVENTION

1. Field of the Invention

The present invention relates to a filament for an X-ray tube, and more specifically to a coiled filament with an improvement in temperature distribution uniformity along the longitudinal direction of the filament. The present invention also relates an X-ray tube having such a filament.

2. Description of the Related Art

A coiled filament for an X-ray tube preferably gives itself a uniform temperature distribution as far as possible over the whole length of the filament. The ordinary coiled filament for an X-ray tube has a constant wire diameter and a constant coil pitch, and therefore its temperature becomes highest at the longitudinal center and drops in the vicinity of the both ends. If the temperature distribution of the filament is uniform, the intensity distribution of an electron beam emitted from the filament becomes uniform, so that the brightness distribution of an X-ray focus becomes uniform, the X-ray focus being made by the electron bombardment on the target (i.e., the anode) of an X-ray tube. In addition, if the temperature distribution of the filament is uniform, the amount of wire diameter wear of the coil becomes uniform as compared with a filament which is not uniform in temperature distribution, so that the lifetime is prolonged. Furthermore, if the temperature distribution of the coil is uniform, the maximum temperature of the filament can be lowered for obtaining the same X-ray tube current as compared with the filament which is not uniform in temperature distribution, so that the lifetime is prolonged as well.

While the present invention is concerned with a longitudinal variation in coil shape of the filament for an X-ray tube, the prior art most relevant thereto is disclosed in Japanese Utility Model Publication No. 6-9047 U (1994), which will be referred to as the first publication.

The first publication discloses that a filament for an X-ray tube has a particular coil pitch which is dense in the vicinity of the center and sparse in the vicinity of the both ends, so that the temperature in the vicinity of the center of the filament rises to make the electron density distribution Gaussian. It is considered accordingly that the prior art filament does not make the temperature distribution uniform but rather makes the temperature in the vicinity of the center higher than the ordinary coil having a constant coil pitch. The coiled filament of the first publication is 80 turns per inch in coil pitch in the vicinity of the center and 50 turns per inch in the vicinity of the both ends for example.

On the other hand, in the technical field other than the X-ray tube, a longitudinal variation in wire diameter of a coiled filament is known and disclosed for example in Japanese Patent Publication No. 58-26144 B (1983), which will be referred to as the second publication.

The second publication relates to a lamp for the fixing unit of a copying machine and discloses a longitudinal variation in wire diameter of a coiled filament. More specifically, the wire diameter of the filament is reduced at the longitudinal ends than at the longitudinal center, so that the heating value is increased at the longitudinal ends to raise the irradiance at the ends than at the center. A method of reducing the wire diameter at the ends is disclosed in the second publication and is the electropolishing method. The second publication also mentions a continuous variation of the wire diameter, which is realized by moving up and down the liquid level of the electropolishing solution or by moving up and down the filament so as to vary the dipping time of the filament in the electropolishing solution depending on the longitudinal position of the filament.

It would be thought of from the knowledge of the second publication that in the filament also for the X-ray tube the wire diameter is preferably reduced at the longitudinal ends to raise the heating value at those regions, so that the longitudinal temperature distribution becomes uniform. Even if the wire diameter is reduced, however, there would remain a peculiar problem specific to the X-ray tube filament, which will be explained below.

In the second publication, the electropolishing method is used for reducing the wire diameter at the longitudinal ends, the method being as follows: a glass vessel is filled with ten-percent aqueous sodium hydroxide solution as the electropolishing solution; a tungsten plate is immersed in the solution to be the electrode; only the end region of the filament is immersed in the solution; and a voltage is supplied between the filament and the electrode so that the end region is electropolished. With this method, the wire diameter is certainly reduced at the longitudinal ends, but the coil outside diameter is also reduced at the longitudinal ends together with the reduction of the wire diameter. Accordingly, the filament made with such a method has a coil outside diameter which is smaller at the longitudinal ends than at the longitudinal center.

In the filament for the X-ray tube, if the outside diameter of the coiled filament varies along the longitudinal direction, the following problem is raised. The distance between the target and the filament in the X-ray tube affects the course of the electron beam traveling from the filament to the target and affects also the brightness of the X-ray focus on the target. Stating in detail, if the coil outside diameter varies along the longitudinal direction of the filament, the distance described above varies delicately, so that it adversely affects the brightness distribution of the X-ray focus. Therefore, it is important for the X-ray tube filament to keep the coil outside diameter constant along the longitudinal direction. For the reasons mentioned above, the known countermeasure, which is reduction of the wire diameter at the longitudinal ends so as to make the longitudinal temperature distribution uniform, disclosed in the second publication would not be applicable to the X-ray tube filament in a general way.

SUMMARY OF THE INVENTION

It is an object of the present invention to provide a filament for an X-ray tube in which even if the wire diameter of the filament varies, the coil outside diameter does not vary, so that the temperature distribution along the longitudinal direction of the filament becomes uniform.

It is another object of the present invention to provide an X-ray tube having such a filament.

A filament for an X-ray tube according to the present invention is a coiled filament which comprises a coil having a wire diameter which decreases gradually from a longitudinal central region of the filament toward longitudinal ends of the filament. In addition, a coil outside diameter is constant along a longitudinal direction of the coil. This feature is accomplished by polishing the wire only at an inside of the coil to reduce the wire diameter, and the polishing amount is gradually increased from the longitudinal central region to the longitudinal ends. As a result, the coil outside diameter is fixed while the coil inside diameter is gradually increased from the longitudinal central region toward the longitudinal ends.

The longitudinal central region in the present invention may have one turn or plural turns. When having the plural turns, the plural turns in the central region have the same wire diameter and the wire diameter is gradually reduced from the central region toward the longitudinal ends.

It is preferable, for making the longitudinal temperature distribution uniform as far as possible, that the distance Δd between the wire diameter $d_{max}$ at the longitudinal central region and the wire diameter $d_{min}$ at the longitudinal ends satisfies the following limitation, $$\Delta d/d_{max}=0.041 \text{ to } 0.145.$$

In addition, an X-ray tube according to the present invention comprises the filament for an X-ray tube having the feature mentioned above.

The present invention has an advantage that a uniform longitudinal temperature distribution in the coiled filament is obtained, which is accomplished by improving variation of the wire diameter as described above. For example, when the filament is heated to about 2,500 degrees C. in temperature, the temperature difference between the longitudinal central region of the filament and the second turn from the outermost end of the filament falls within 50 degrees C. Furthermore, since the coil outside diameter is constant along the longitudinal direction, there is no adverse effect on the X-ray focus.

BRIEF DESCRIPTION OF THE DRAWINGS

FIG. 5 shows a table including observed values and recommended values;

DETAILED DESCRIPTION OF THE PREFERRED EMBODIMENTS

Figure 1:
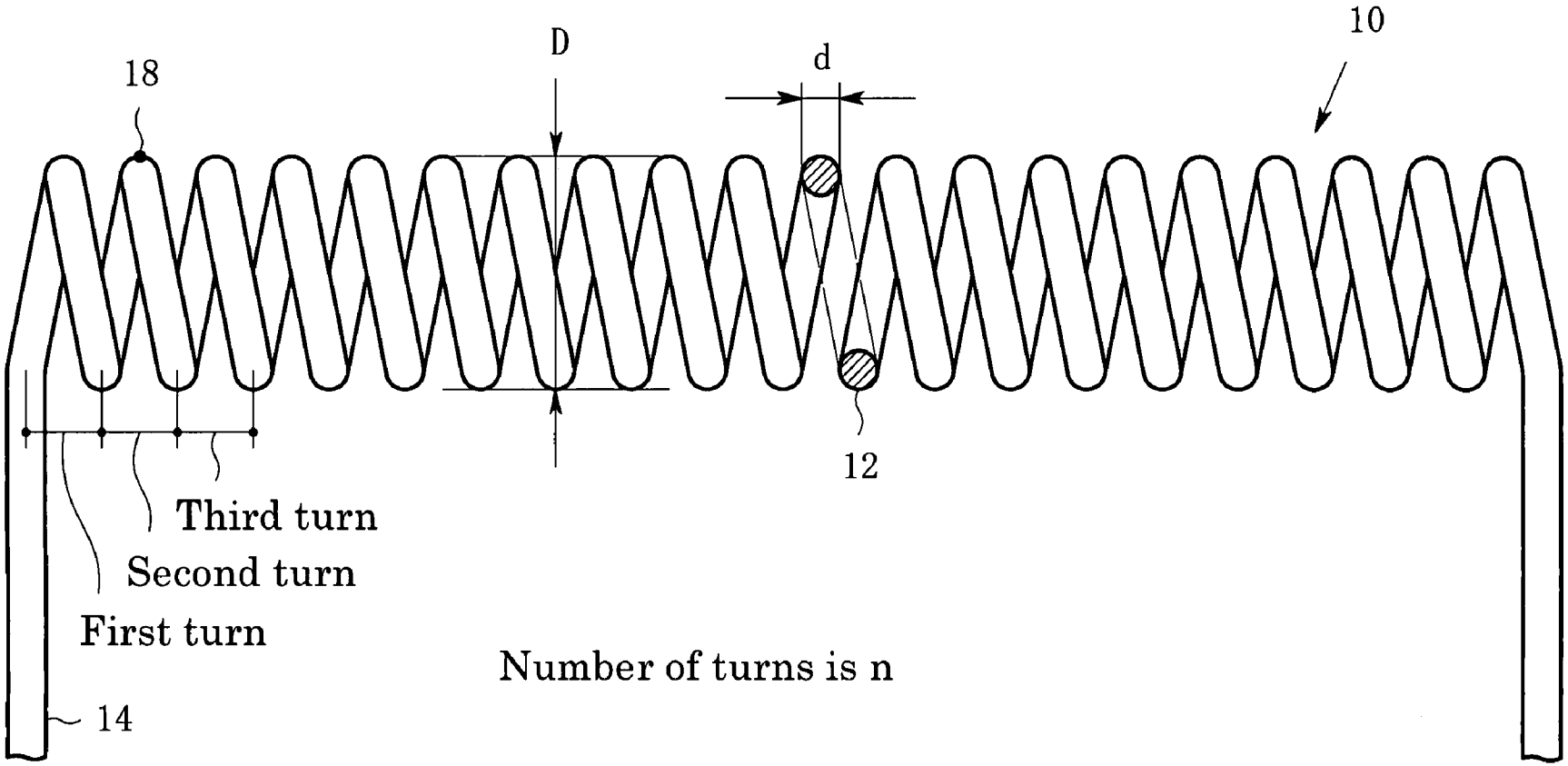
FIG. 1 is a front view of one embodiment of a filament according to the present invention.

Embodiments of the present invention will now be described in detail below with reference to the drawings. Referring to FIG. 1 which is a front view of one embodiment of a filament according to the present invention, a filament 10 is made of a wire 12 having a wire diameter d, the wire 12 being wound with n-turns to be a coiled shape having an outside diameter D. The both ends of the filament 10 are integrally connected to lead wires 14. In this embodiment, the number of turns n is twenty. In the figure, the leftmost turn will be referred to as the first turn hereinafter, and the other turns are, toward to the right, the second turn and the third turn and so on, and finally the rightmost turn is the twentieth turn.

Figure 2:
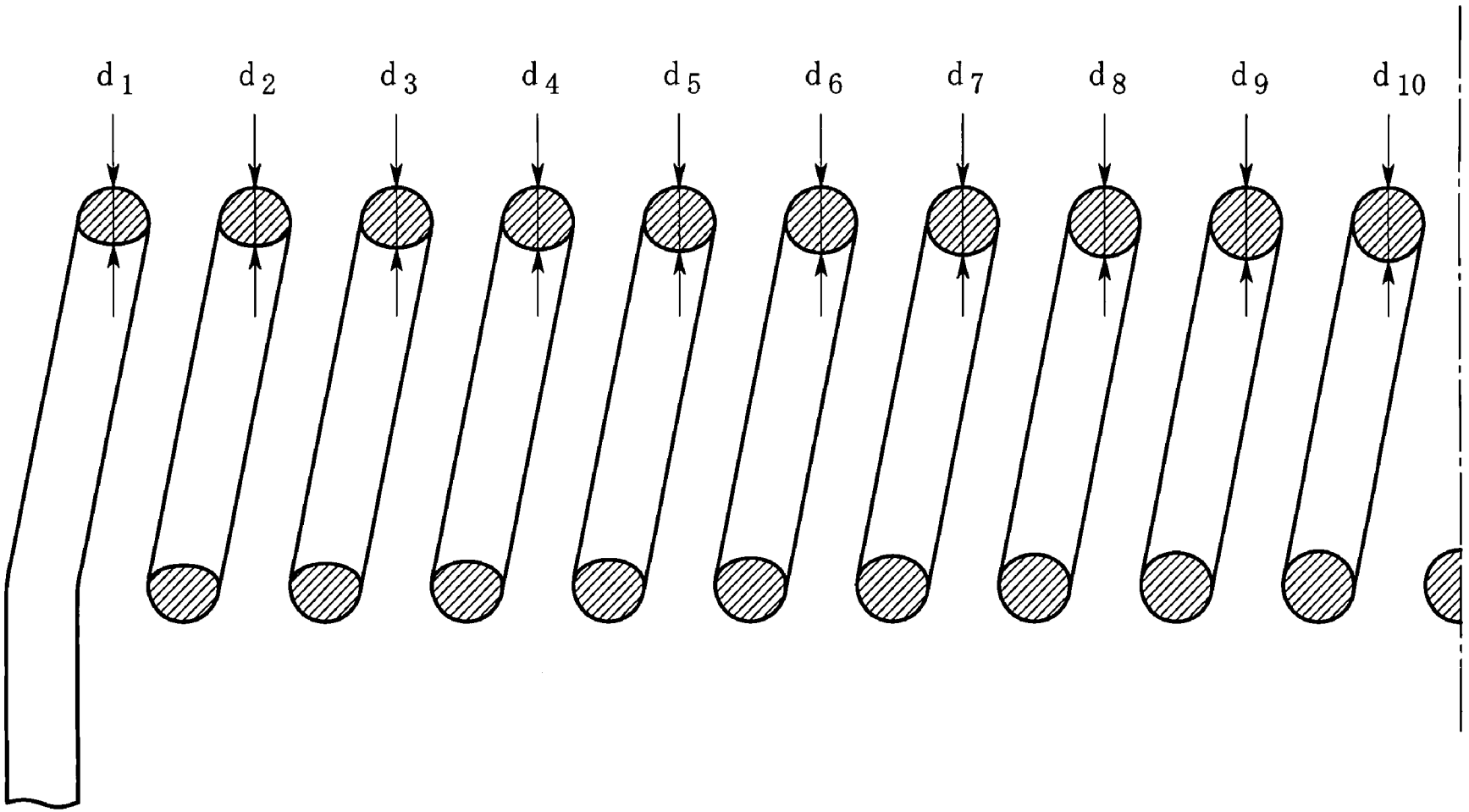
FIG. 2 is an enlarged sectional view of the left half of the filament shown in FIG. 1.

Referring to FIG. 2 which is an enlarged sectional view of the left half of the filament shown in FIG. 1, the wire diameter d of the filament varies gradually along the longitudinal direction of the filament. The wire diameter at the center of the first turn is $d_1$, and the wire diameter at the center of the second turn is $d_2$, and similarly the wire diameters at the centers of the other turns are $d_3$ to $d_{10}$.

Figure 3:
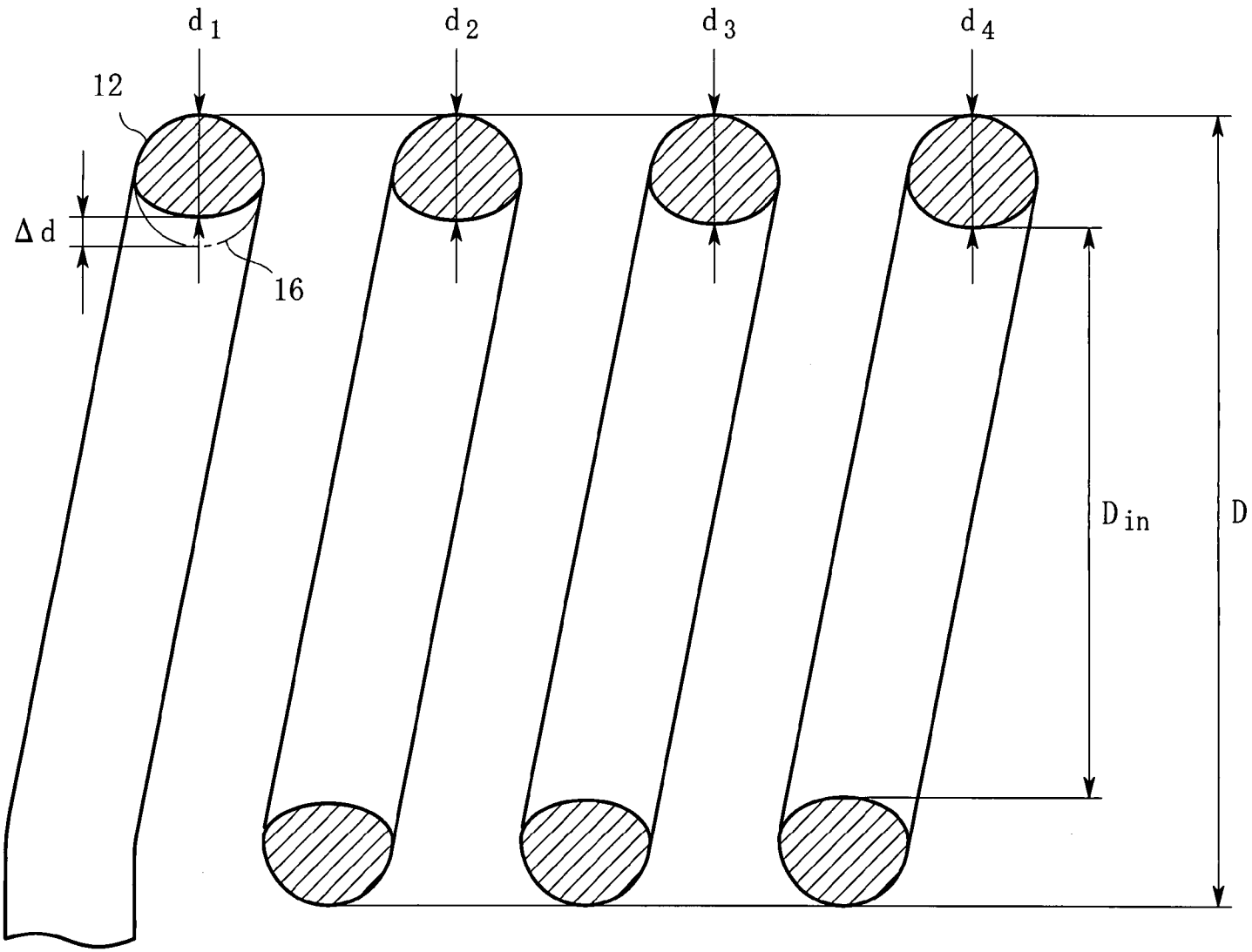
FIG. 3 is a further enlarged sectional view of a region in the vicinity of the left end of the filament shown in FIG. 2.

Referring to FIG. 3 which is a further enlarged sectional view of a region in the vicinity of the left end of the filament shown in FIG. 2, although the original wire diameter d is 0.3 mm before the filament production, the wire diameter $d_1$ at the center of the first turn is 0.26 mm. Stating in detail, the wire 12 has been polished with a certain amount by electropolishing at only the inside of the coil. Comparing with the surface 16 of the original wire, the amount of reduction Δd at the inside is 0.04 mm. The wire diameter $d_2$ at the center of the second turn is slightly greater than $d_1$. Similarly, the wire diameter is gradually increased toward the central region of the filament. While the outside diameter D of the coil is fixed over the whole length of the filament, the inside diameter $D_{in}$ varies along the longitudinal direction of the filament in response to the longitudinal variation of the wire diameter. The inside diameter $D_{in}$ is gradually increased from the longitudinal central region toward the longitudinal ends.

Figure 4:
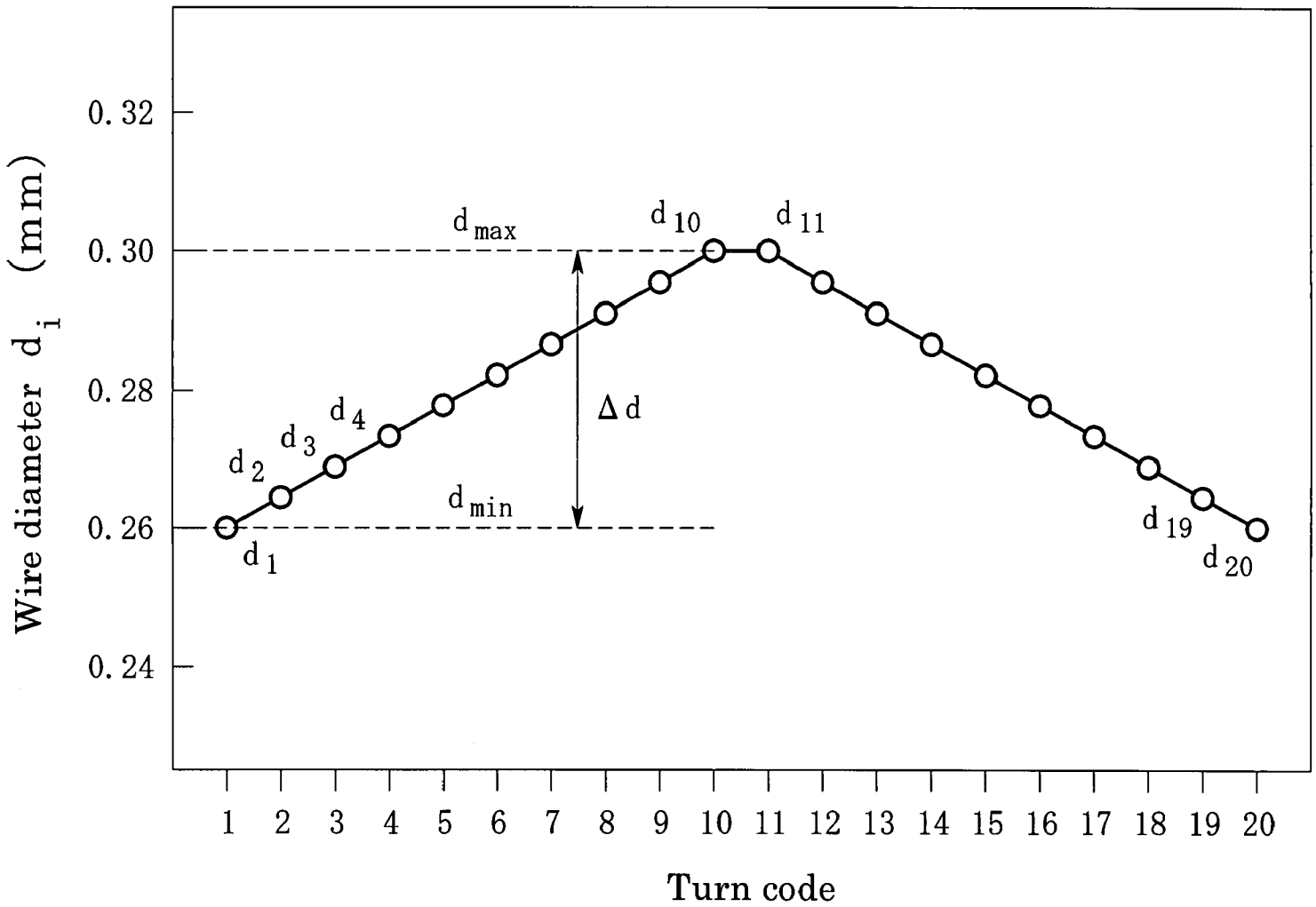
FIG. 4 is a graph showing a variation of the wire diameter.

FIG. 4 is a graph showing a variation of the wire diameter, the turn code of the coiled filament is in abscissa and the wire diameter, $d_i$ (i is one through twenty) at the center of each turn is in ordinate. The longitudinal central region of the filament consists of the tenth and eleventh turns, whose diameters are $d_{10}$ and $d_{11}$, these diameters being the same as the original diameter of the wire. The wire diameter at the longitudinal central region is the maximum diameter which is denoted by $d_{max}$. The longitudinal ends include the first and twentieth turns, whose diameters are $d_1$ and $d_{20}$, each of these diameters being the minimum diameter which is denoted by $d_{min}$. The difference between $d_{max}$ and $d_{min}$ is the wire diameter difference Δd. In the embodiment, $d_{max}$ is 0.30 mm, $d_{min}$ is 0.26 mm, and therefore the wire diameter difference Δd is 0.04 mm. The wire diameter of each turn is linearly reduced from the wire diameter $d_{10}$ toward the wire diameter $d_1$, and similarly reduced from the wire diameter $d_{11}$ toward the wire diameter $d_{20}$.

The number of turns having the maximum wire diameter $d_{max}$ is one (when n is odd) or two (when n is even) at the smallest, but may be three or more.

Since the wire diameter decreases gradually toward the longitudinal ends as shown in FIG. 4, the longitudinal temperature distribution becomes uniform. If the wire diameter is constant and the coil pitch is constant too, the longitudinal temperature distribution of the filament becomes higher at the central region than the both ends to be a convex shape. In contrast, when the wire diameter decreases gradually toward the both ends, the electric resistance is increased with the wire diameter reduction to increase the heating value, so that the temperature drop toward the both ends is prevented.

Referring to FIG. 5 showing a table, the upper part of the table indicates observed temperature differences between the longitudinal central region and the longitudinal end for four kinds of filaments having four kinds of wire diameter differences Δd. The coil specification common to all observed filaments is as follows: the original wire diameter (i.e., $d_{max}$) is 0.30 mm; the coil outside diameter D is 3.0 mm; the number of turns n is twenty; and the coil pitch is 0.65 mm. An electric current is supplied to these filaments to heat them so that the temperature at the longitudinal central region of the filament reaches about 2,500 degrees C. Under the condition, there was observed a temperature difference ΔT at the uppermost point 18 (see FIG. 1) of the second turn on the basis of the temperature at the longitudinal central region of the filament. The temperature was measured with the use of an optical pyrometer. It should be noted that the temperature of the uppermost point of the second turn was used as the temperature of the end in view of the temperature distribution, because the temperature of the outermost first turn considerably drops and thus it is not suitable for estimation of the temperature distribution uniformity.

When the wire diameter difference Δd was 0 mm (i.e., the wire diameter was fixed), the temperature difference ΔT became negative 109 degrees C. Thus, in the conventional condition, the temperature at the end certainly drops than at the central region. In contrast, when Δd was 0.04 mm as in the embodiment, the temperature difference became positive 42 degrees C. Since the wire diameter is reduced to increase the heating value toward the end, the temperature at the end became slightly higher than at the central region. When Δd was 0.085 mm, the temperature difference was expanded to positive 115 degrees C. When Δd was 0.123 mm, the temperature difference was further expanded to positive 160 degrees C.

Figure 6:
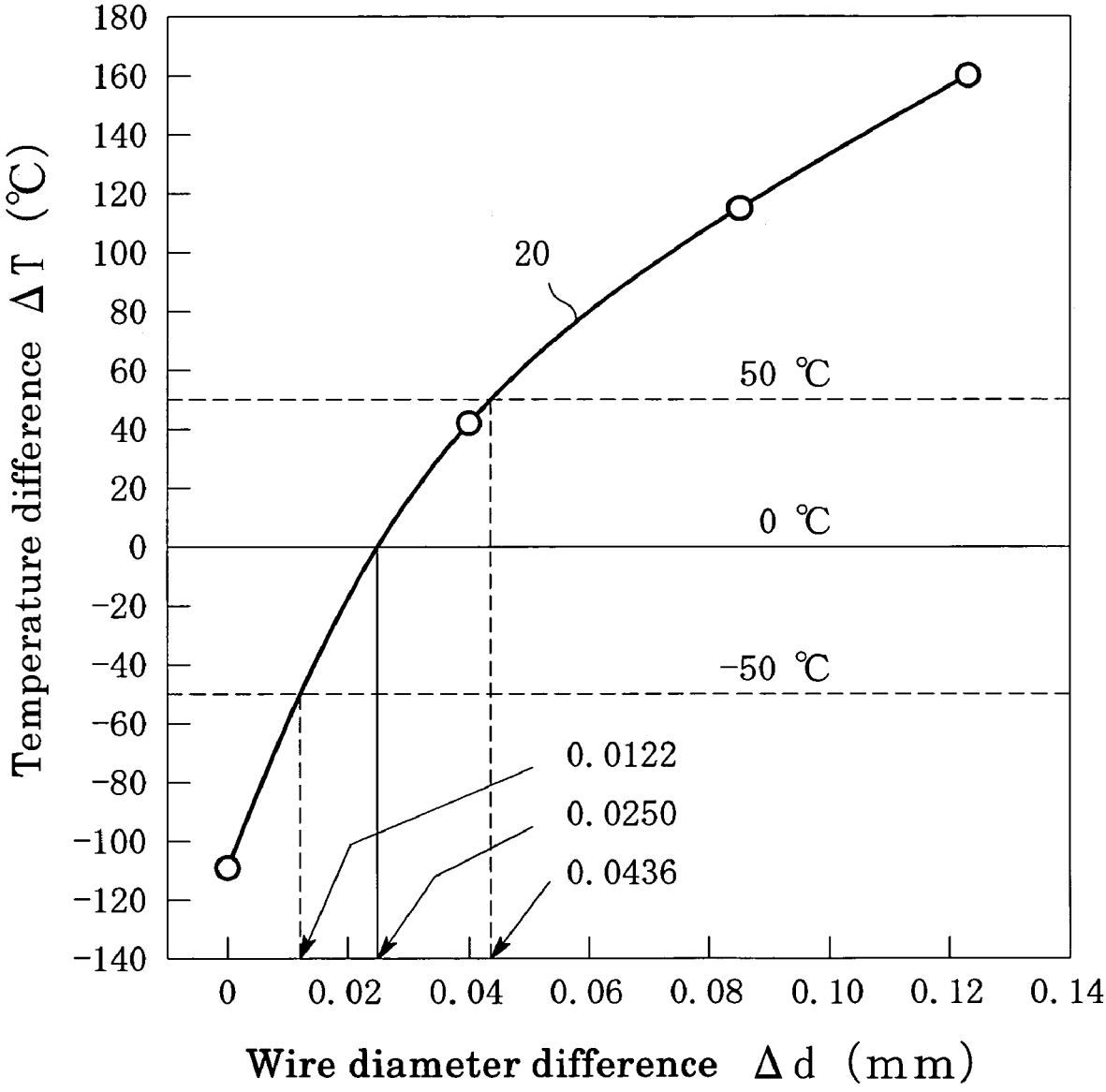
FIG. 6 is a graph of the measurement results.

FIG. 6 is a graph of the measurement results which appear in the upper part of the table of FIG. 5, in which the wire diameter difference Δd is in abscissa and the temperature difference ΔT is in ordinate. Four observed values are indicated by white circles and they are connected with each other with a smooth curve 20. Inspecting the wire diameter difference Δd at which the curve 20 comes across a line of ΔT being zero degree C., it is 0.0250 mm. Accordingly, it is predicted that if the wire diameter difference is set to 0.0250 mm, the temperature difference between the central region and the both ends becomes almost nothing. In addition, the wire diameter difference Δd at which the curve 20 comes across a line of ΔT being negative 50 degrees C. is 0.0122 mm, and Δd when the curves 20 comes across positive 50 degrees C. is 0.0436 mm. Assuming that 50 degrees C. in difference is allowable in view of making the longitudinal temperature distribution of the filament uniform, the wire diameter difference Δd may be preferably set within a range of 0.0122 to 0.0436 mm, so that there is obtained an ideal filament which gives itself the almost uniform longitudinal temperature distribution.

In the table of FIG. 5, the lower part of the table indicates recommended values of the wire diameter differences Δd, which have been obtained for above-mentioned zero, negative 50 and positive 50 degrees in temperature difference. The rightmost column in the table of FIG. 5 indicates normalized values which are obtained by dividing the wire diameter differences Δd by the central wire diameter $d_{max}$. Considering the normalized values, the wire diameter difference $\Delta d/d_{max}$ with which the temperature difference falls in a range between negative 50 degrees and positive 50 degrees should be 0.041 to 0.145. That is to say, the wire diameter at the end should be reduced by 4.1 to 14.5 percent as compared with the central wire diameter. If a filament for use has a central wire diameter which is different from the embodiment mentioned above, an optimum wire diameter difference should be set based on the normalized wire diameter difference.

Figure 9:
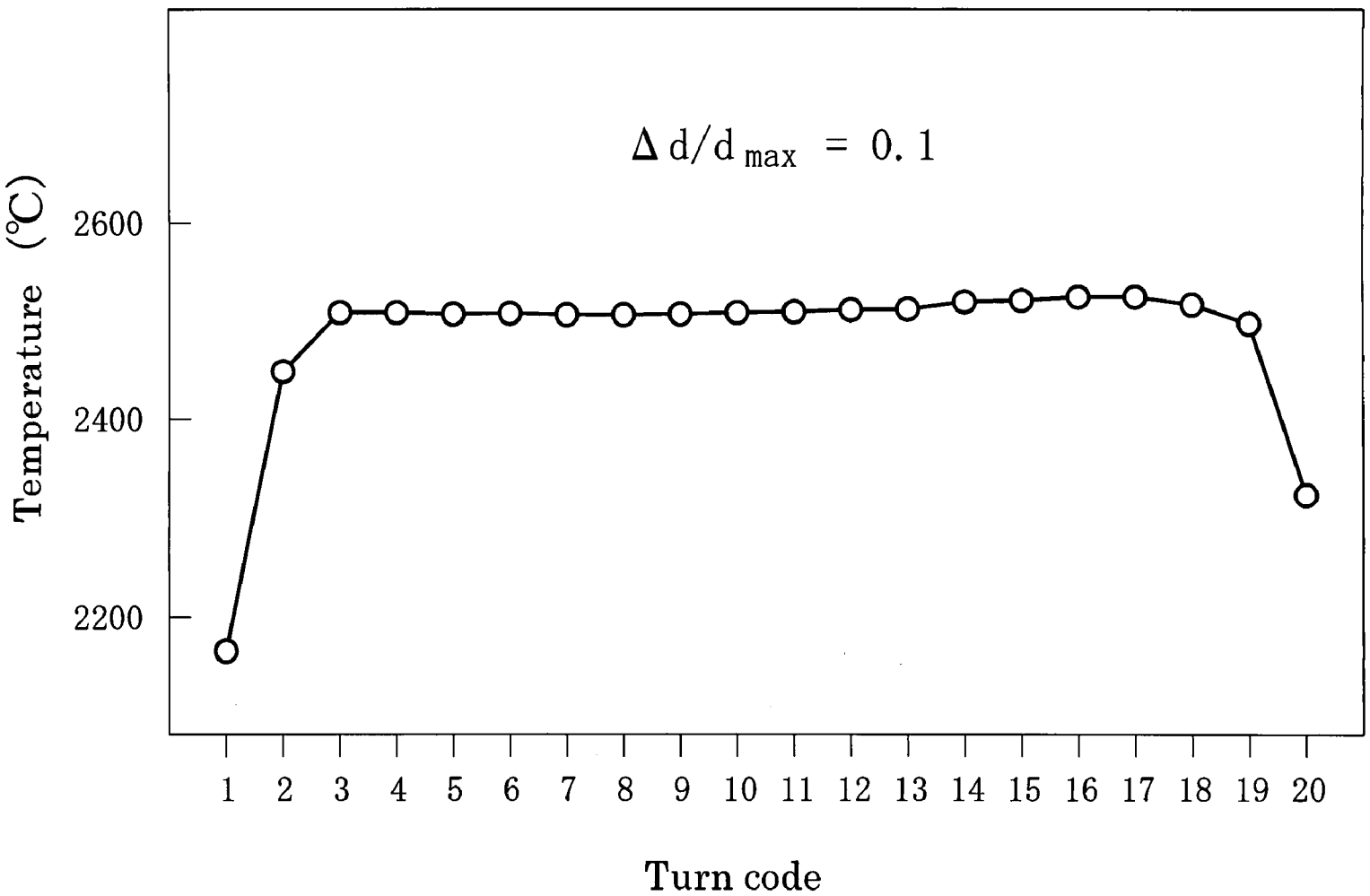
FIG. 9 is a graph showing the temperature distribution of a filament having a wire diameter difference.

FIG. 9 is a graph showing the temperature distribution of a filament having a wire diameter difference, noting that the filament is different from the filament indicated in the table of FIG. 5. The longitudinal temperature distribution of the filament was measured when an electric current was supplied to the filament to heat it up to about 2,500 degrees C. In the graph, the turn code is in abscissa and the temperature is in ordinate. The temperature of each turn was measured at the uppermost point of each turn (for example, see the uppermost point 18 in FIG. 1) with the use of the optical pyrometer. The filament has a coil specification which is as follows: the wire diameter d is 0.4 mm; the wire diameter difference Δd is 0.04 mm; the coil outside diameter D is 3 mm; the number of turns n is twenty; and the coil pitch p is 0.65 mm. Accordingly, $\Delta d/d_{max}$ is 0.1, which satisfies the above-mentioned recommended limitation that $\Delta d/d_{max}$ is within a range of 0.041 to 0.145. Looking at the temperature distribution of the graph, it is seen that the temperature distribution becomes uniform, the temperature at the longitudinal central region being not higher than other regions.

Figure 10:
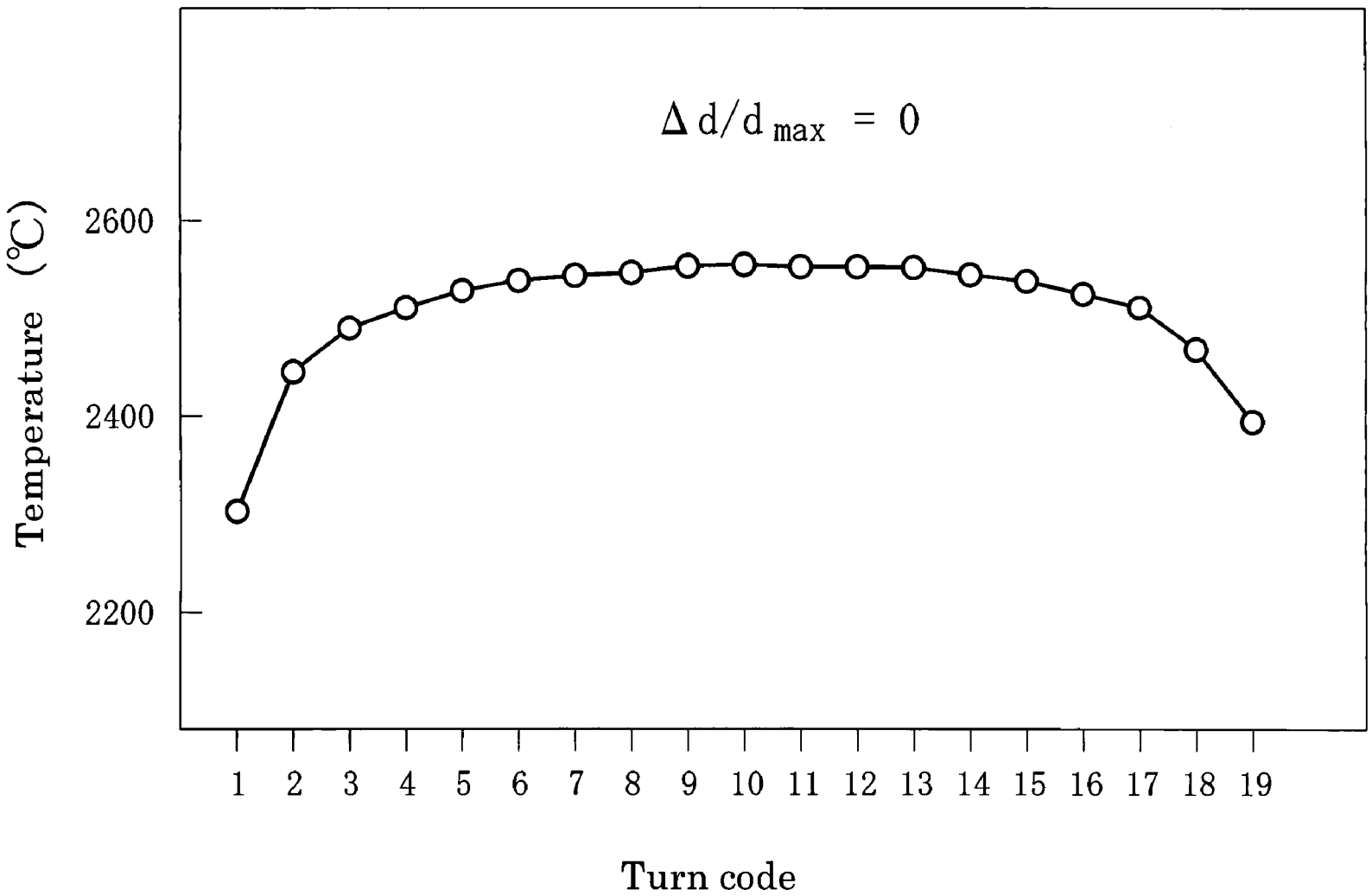
FIG. 10 is a graph showing the temperature distribution of the conventional filament.

FIG. 10 is a graph showing the temperature distribution of the conventional filament. The filament has a wire diameter which is constant and its coil specification is as follows: the wire diameter d is 0.4 mm; the coil outside diameter D is 3 mm; the number of turns n is nineteen; and the coil pitch p is 0.65 mm. Since the wire diameter difference Δd is zero, the value of $\Delta d/d_{max}$ is zero too. Looking at the temperature distribution of the graph, it is seen that the temperature at the longitudinal central region is higher than other regions and the temperature gradually drops toward the both ends. Compared with the temperature distribution of the conventional filament, the filament shown in FIG. 9 has a good uniformity of temperature distribution.

Figure 7:
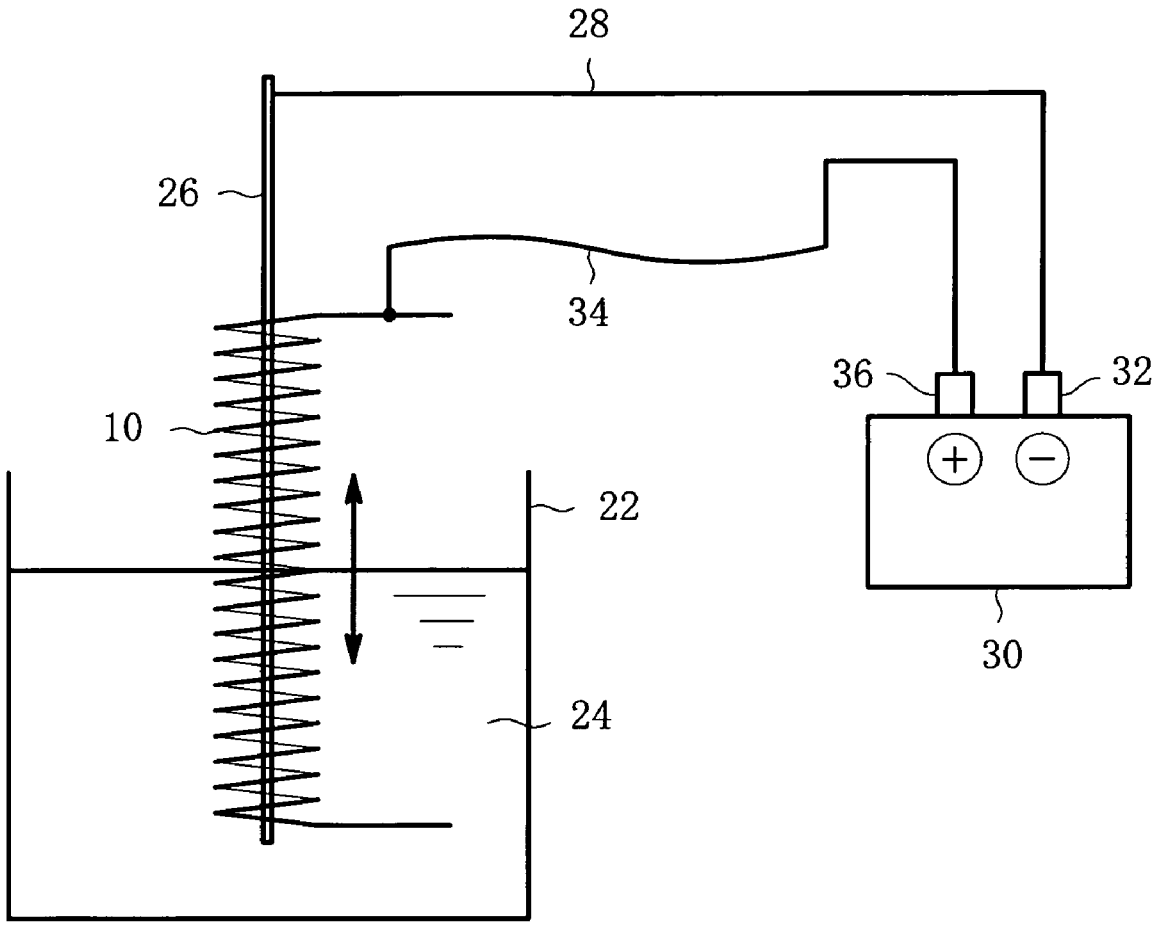
FIG. 7 is an explanatory drawing of the electropolishing method.

FIG. 7 is an explanatory drawing of the electropolishing method in which the wire diameter is reduced by polishing at only inside of the coil. A glass vessel 22 is filled with an electropolishing solution 24, which is an aqueous sodium hydroxide solution including 5 mg sodium hydroxide per 500 mg water. An electrode rod 26 is a stainless steel slender rod having a diameter of 0.5 mm. The electrode rod 26 is connected through a lead wire 28 to the negative terminal 32 of a power supply 30. A tungsten coiled filament 10 is dipped with the upright posture in the electropolishing solution 24 so that the electrode rod 26 is arranged in the center of the filament 10. The filament 10 is connected through a lead wire 34 to the positive terminal 36 of the power supply 30. A voltage is supplied between the filament 10 and the electrode rod 26 to carry out electropolishing for a predetermined time.

The filament 10 is moved up and down cyclically during the electropolishing while the electrode rod 26 remains stationary. When the filament 10 is moved downward to the lowermost position, the longitudinal central region of the filament precisely reaches the liquid level of the electropolishing solution 24. When the filament 10 is moved upward to the uppermost position, the longitudinal end of the filament precisely reaches the liquid level of the electropolishing solution 24. With the up and down reciprocal motion, the time with which a part of the filament 10 is being immersed in the electropolishing solution varies continuously depending on the longitudinal position of the filament, so that the electropolishing is carried out with the condition that more close to the end, the more with a longer time, and more close to the central region, the more with a shorter time. As a result, the wire diameter is reduced almost linearly from the central region to the end. After the electropolishing of the one half of the filament has been completed, the other half is similarly electropolished, so that the wire diameter is reduced at the longitudinal both ends.

Since the electrode rod 26 resides in the center of the filament 10, the wire of the filament 10 is to be electropolished at substantially only the inside of the coil, while the coil outside diameter remains almost constant over the whole length of the filament.

Figure 8:
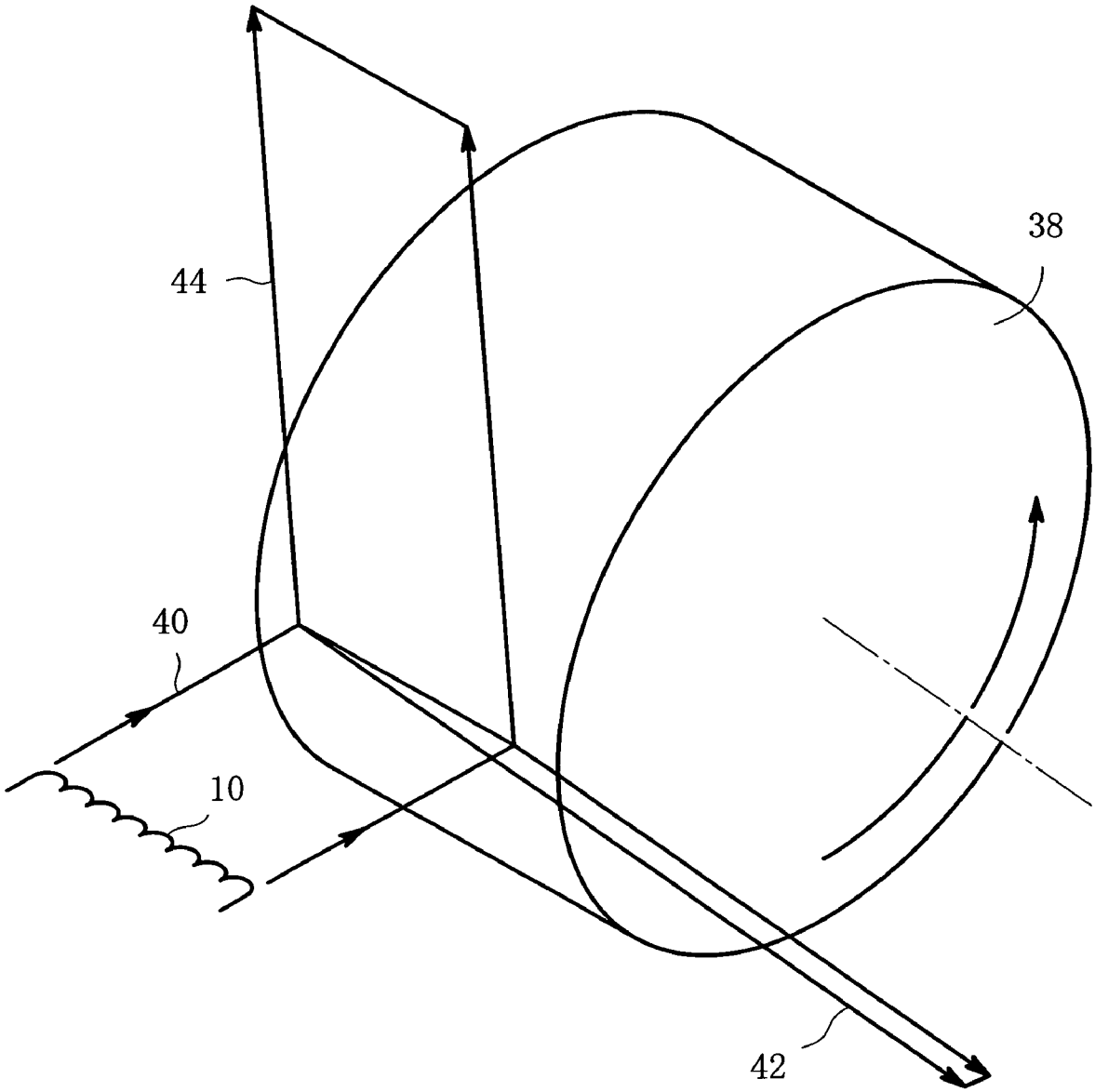
FIG. 8 is a perspective view of a major part of an X-ray tube having a filament according to the present invention.

FIG. 8 is a perspective view of a major part of an X-ray tube having the filament which is produced by the improved method mentioned above. When an electric current is supplied to the filament 10 and a high voltage is supplied between the filament 10 and a rotating anode 38, the filament 10 emits an electron beam 40. The electron beam 40 impinges against the periphery of the rotating anode 38 to generate an X-ray beam, which may be taken out, for example, as a point focus X-ray beam 42 or a line focus X-ray beam 44.

The filament according to the present invention is not limited to the rotating anode X-ray tube but is applicable to the fixed target (i.e., stationary target) X-ray tube.

What is claimed is:

1. A coiled filament for an X-ray tube comprising a coil having:

a wire diameter which decreases gradually from a longitudinal central region of the coil toward longitudinal ends of the filament; and an outside diameter which is constant along a longitudinal direction of the filament.

2. A coiled filament for an X-ray tube according to claim 1, wherein the coil has an inside diameter which increases gradually from the longitudinal central region of the filament toward the longitudinal ends of the filament.

3. A coiled filament for an X-ray tube according to claim 2, wherein a difference Δd between the wire diameter $d_{max}$ at the longitudinal central region and the wire diameter $d_{min}$ at the longitudinal ends satisfies a following limitation:

$$\Delta d/d_{max}=0.041 \text{ to } 0.145.$$

4. A coiled filament for an X-ray tube according to claim 1, wherein a difference Δd between the wire diameter $d_{max}$ at the longitudinal central region and the wire diameter $d_{min}$ at the longitudinal ends satisfies a following limitation:

$$\Delta d/d_{max}=0.041 \text{ to } 0.145.$$

5. An X-ray tube comprising a coiled filament which includes a coil having:

a wire diameter which decreases gradually from a longitudinal central region of the filament toward longitudinal ends of the filament; and an outside diameter which is constant along a longitudinal direction of the filament.

6. An X-ray tube according to claim 5, wherein the coil has an inside diameter which increases gradually from the longitudinal central region of the filament toward the longitudinal ends of the filament.

7. An X-ray tube according to claim 6, wherein a difference Δd between the wire diameter $d_{max}$ at the longitudinal central region and the wire diameter $d_{min}$ at the longitudinal ends satisfies a following limitation:

$$\Delta d/d_{max}=0.041 \text{ to } 0.145.$$

8. An X-ray tube according to claim 5, wherein a difference Δd between the wire diameter $d_{max}$ at the longitudinal central region and the wire diameter $d_{min}$ at the longitudinal ends satisfies a following limitation:

$$\Delta d/d_{max}=0.041 \text{ to } 0.145.$$

* * * * *